US010373436B2

(12) United States Patent
Arnone et al.

(10) Patent No.: US 10,373,436 B2
(45) Date of Patent: Aug. 6, 2019

(54) COINCIDENT GAMBLING HYBRID GAMING SYSTEM

(71) Applicant: Gamblit Gaming, LLC, Glendale, CA (US)

(72) Inventors: Miles Arnone, Sherborn, MA (US); Caitlyn Ross, Watertown, MA (US)

(73) Assignee: Gamblit Gaming, LLC, Glendale, CA (US)

( * ) Notice: Subject to any disclaimer, the term of this patent is extended or adjusted under 35 U.S.C. 154(b) by 455 days.

(21) Appl. No.: 14/586,626

(22) Filed: Dec. 30, 2014

(65) Prior Publication Data

US 2015/0119127 A1 Apr. 30, 2015

Related U.S. Application Data

(63) Continuation of application No. PCT/US2013/048755, filed on Jun. 28, 2013.

(60) Provisional application No. 61/666,867, filed on Jun. 30, 2012.

(51) Int. Cl.
*G07F 17/32* (2006.01)

(52) U.S. Cl.
CPC ..... *G07F 17/326* (2013.01); *G07F 17/3244* (2013.01); *G07F 17/3295* (2013.01)

(58) Field of Classification Search
CPC .... G07F 17/32; G07F 17/3244; G07F 17/326; G07F 17/3295; G07F 17/3286; G07F 17/3262; G07F 17/3269
USPC ..... 463/7, 16, 20, 25, 1, 9, 23
See application file for complete search history.

(56) References Cited

U.S. PATENT DOCUMENTS

| | | | | |
|---|---|---|---|---|
| 5,413,357 | A | 5/1995 | Schulze et al. | |
| 5,718,429 | A | 2/1998 | Keller | |
| 5,746,656 | A * | 5/1998 | Bezick | A63F 13/12 463/42 |
| 5,785,592 | A | 7/1998 | Jacobsen | |
| 5,853,324 | A | 12/1998 | Kami et al. | |
| 5,963,745 | A | 10/1999 | Collins et al. | |
| 6,050,895 | A | 4/2000 | Luciano | |
| 6,165,071 | A | 12/2000 | Weiss | |
| 6,227,974 | B1 | 5/2001 | Eilat | |
| 6,267,669 | B1 | 7/2001 | Luciano | |
| 6,685,563 | B1 | 2/2004 | Meekins et al. | |
| 6,712,693 | B1 | 3/2004 | Hettinger | |
| 6,761,632 | B2 | 7/2004 | Bansemer et al. | |
| 6,761,633 | B2 | 7/2004 | Riendeau | |

(Continued)

OTHER PUBLICATIONS

U.S. Appl. No. 14/205,303 Arnone, et al., filed Mar. 11, 2014.

(Continued)

*Primary Examiner* — William H McCulloch, Jr.
*Assistant Examiner* — Chase E Leichliter
(74) *Attorney, Agent, or Firm* — Frank Cire; Caitlyn Ross

(57) ABSTRACT

Systems for providing a coincident gambling hybrid game having coincident gambling and game events is disclosed. The systems involve receive an input from a player. An action event in the game is then determined from the input. A gambling event that is associated with the action event is then determined. Any wagers on the gambling event are also. The results of the gambling event are then determined and the wagers are resolved. A random outcome used to determine a result of the gambling event is then used to change variables in a set of game variables and are applied in the game.

6 Claims, 14 Drawing Sheets

(56) References Cited

U.S. PATENT DOCUMENTS 6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 7/2010 Walker et al.
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,938,727 B1 5/2011 Konkle
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,475,266 B2 7/2013 Arnone
8,480,470 B2 7/2013 Napolitano et al.
8,622,809 B1 1/2014 Arora et al.
2001/0004609 A1 6/2001 Walker et al.
2001/0019965 A1 9/2001 Ochi
2002/0022509 A1 2/2002 Nicastro
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0097610 A1 5/2004 Saito
2004/0102238 A1 5/2004 Taylor
2004/0121839 A1 6/2004 Webb
2004/0225387 A1 11/2004 Smith
2005/0003878 A1 1/2005 Updike
2005/0059446 A1* 3/2005 Kaminkow ..... G07F 17/32 463/7
2005/0096124 A1 5/2005 Stronach
2005/0116411 A1 6/2005 Herrmann et al.
2005/0192087 A1 9/2005 Friedman et al.
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 8/2006 Walker et al.
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Mattice
2007/0293306 A1 12/2007 Nee et al.
2008/0004107 A1 1/2008 Nguyen et al.
2008/0014835 A1 1/2008 Weston et al.
2008/0015004 A1* 1/2008 Gatto ..... G07F 17/32 463/16
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen
2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Erfanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1* 6/2009 Strause ..... G06Q 50/34 463/7
2009/0156297 A1 6/2009 Andersson et al.
2009/0176560 A1 7/2009 Herrmann et al.
2009/0176566 A1 7/2009 Kelly
2009/0181777 A1 7/2009 Christiani

(56) References Cited

U.S. PATENT DOCUMENTS

2009/0221355 A1 9/2009 Dunaevsky et al.
2009/0239610 A1 9/2009 Olive
2009/0247272 A1 10/2009 Abe
2009/0270164 A1 10/2009 Seelig
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham et al.
2010/0035674 A1 2/2010 Slomiany
2010/0035679 A1* 2/2010 Oram ..... G07F 17/32 463/25
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0250972 A1* 10/2011 Horbay ..... G06Q 10/10 463/42
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0115581 A1* 5/2012 Englman ..... G07F 17/3258 463/25
2012/0135793 A1 5/2012 Antonopoulos
2012/0178514 A1* 7/2012 Schulzke ..... G07F 17/3295 463/17
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Arnone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0087844 A1* 3/2014 Gilliland ..... A63F 13/00 463/25
2014/0087848 A1* 3/2014 Kosta ..... G07F 17/3218 463/25
2014/0274268 A1* 9/2014 Marshall ..... G07F 17/3244 463/16

OTHER PUBLICATIONS

U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 24, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.
U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.
U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.

(56) References Cited

OTHER PUBLICATIONS

U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
U.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.

* cited by examiner

COINCIDENT GAMBLING HYBRID GAMING SYSTEM

CROSS-REFERENCE TO RELATED APPLICATIONS

This application is a continuation of PCT Application No. PCT/US1348755, filed Jun. 28, 2013 which claims priority to U.S. Provisional Application No. 61/666,867, filed Jun. 30, 2012, the disclosure of each of which is incorporated by reference as if set forth herewith. The current application is also related to PCT Applications: PCT/US11/26768 filed Mar. 1, 2011; PCT/US11/63587 filed Dec. 6, 2011; PCT/US12/32652, filed Apr. 7, 2012; PCT/US12/40548 filed Jun. 1, 2012; and PCT/US12/40800 filed Jun. 4, 2012, all of which are incorporated by reference as if set forth herewith. The current application is further related to U.S. Provisional Patent Applications: 61/459,131 filed Dec. 6, 2010; 61/460,362 filed Dec. 31 2012; and 61/574,753 filed Aug. 9, 2011, all of which are incorporated by reference as if set forth herewith.

FIELD OF THE INVENTION

Embodiments of the present invention are generally related to gaming and more specifically to systems that provide a random number generator that feeds a process that may dictate a gambling game result and trigger a process that affects one or more variables of an entertainment game.

BACKGROUND OF THE INVENTION

The gaming machine manufacturing industry provides a variety of gaming machines to enable wagering for interested parties whilst providing an entertainment experience. An exemplary gaming machine is a slot machine. As the demographic of eligible players has shifted with time to newer generations who have grown accustomed to highly sophisticated graphics and interactive video games, a need has arisen to increase the entertainment content present on a gaming machine to keep it relevant, at least to a growing portion of a casino's patronage. The subject design is a form of gaming machine, designed for use in a physical or virtual casino environment, which provides players an environment in which to play for cash, prizes and points, either against the casino or in head to head modes in a controlled and regulated manner while being allowed to use their skills and adeptness at a particular type of entertainment game. An example of such an entertainment game would be a challenging word spelling game, or an interactive action game such as is found on video game consoles popular today, such as a PlayStation®, an Xbox®, a Wii® or a PC based.

SUMMARY OF THE INVENTION

A distributed coincident gambling hybrid gaming system having coincident gambling and game events provided on a computing device is provided. In accordance with some embodiments, the coincident gambling hybrid gaming system includes an entertainment engine connected by a network to a game world engine, wherein the entertainment engine is configured to: execute an entertainment game on the computing device, including receiving an input and determining an action event in the entertainment game from the input; provide to the game world engine via the network, the action event; receive from the game world engine via the network, a change to a set of game variables; and incorporate the change to the set of game variables into the entertainment game. The distributed coincident gambling hybrid gaming system further includes a real world engine connected to the game world engine, wherein the real world engine is constructed to: receive a request from the game world engine to determine an outcome of a gambling event; determine a random outcome using a random number generator; determine the outcome of the gambling event using the random outcome and a paytable; resolve a wager of the gambling event based on the outcome of the gambling event; manage real world credits of a player based on the wager; and provide to the game world engine the random outcome of the gambling event. The distributed coincident gambling hybrid gaming system includes the game world engine connected by the network to the entertainment engine and connected to the real world engine, wherein the game world engine is constructed to: receive from the entertainment engine via the network, the action event; determine whether the action event is associated with the gambling event; provide to the real world engine, the request to determine the outcome of the gambling event; receive from the real world engine the random outcome; determine the change in the set of game variables based on the random outcome; and provide to the entertainment engine via the network, the change in the set of game variables.

In some embodiments, the game world engine is further constructed to determine the gambling event associated with the action event from the action event and a previous random outcome from the random number generator of the real world engine.

In various embodiments, the game world engine is further constructed to store the random outcome from the random number generator of the gambling event received from the real world engine in a database for use in determining a gambling event associated with an action event.

In some embodiments, the real world engine is further constructed to store the random outcome from the random number generator in a database accessible by the game world engine for use in determining a gambling event associated with an action event.

In many embodiments, the random number generator uses a pseudo number generation process to generate the random outcome.

In various embodiments, the real world engine selects one random number generator from a plurality of random number generators to generate the random number information based on the gambling event.

In some embodiments, the real world engine determines a pay table to use to resolve the wager of the gambling event based upon the gambling event.

In many embodiments, the real world engine and the game world engine are constructed using a same processing apparatus.

In various embodiments, the real world engine and the game world engine are connected by the network.

DETAILED DISCLOSURE OF THE INVENTION

Turning now to the drawings, a coincident gambling hybrid game that provides coincident gambling and game events in accordance with embodiments of the invention is disclosed. In operation, the system uses an RNG which feeds a process that may dictate a gambling game result at the same time it triggers a process that affects one or more variables within the entertainment game. Thus, an action in the entertainment game may both affect the play of the entertainment game and provide an opportunity to wager an outcome of the action.

Coincident Gambling Hybrid Games

Figure 1:
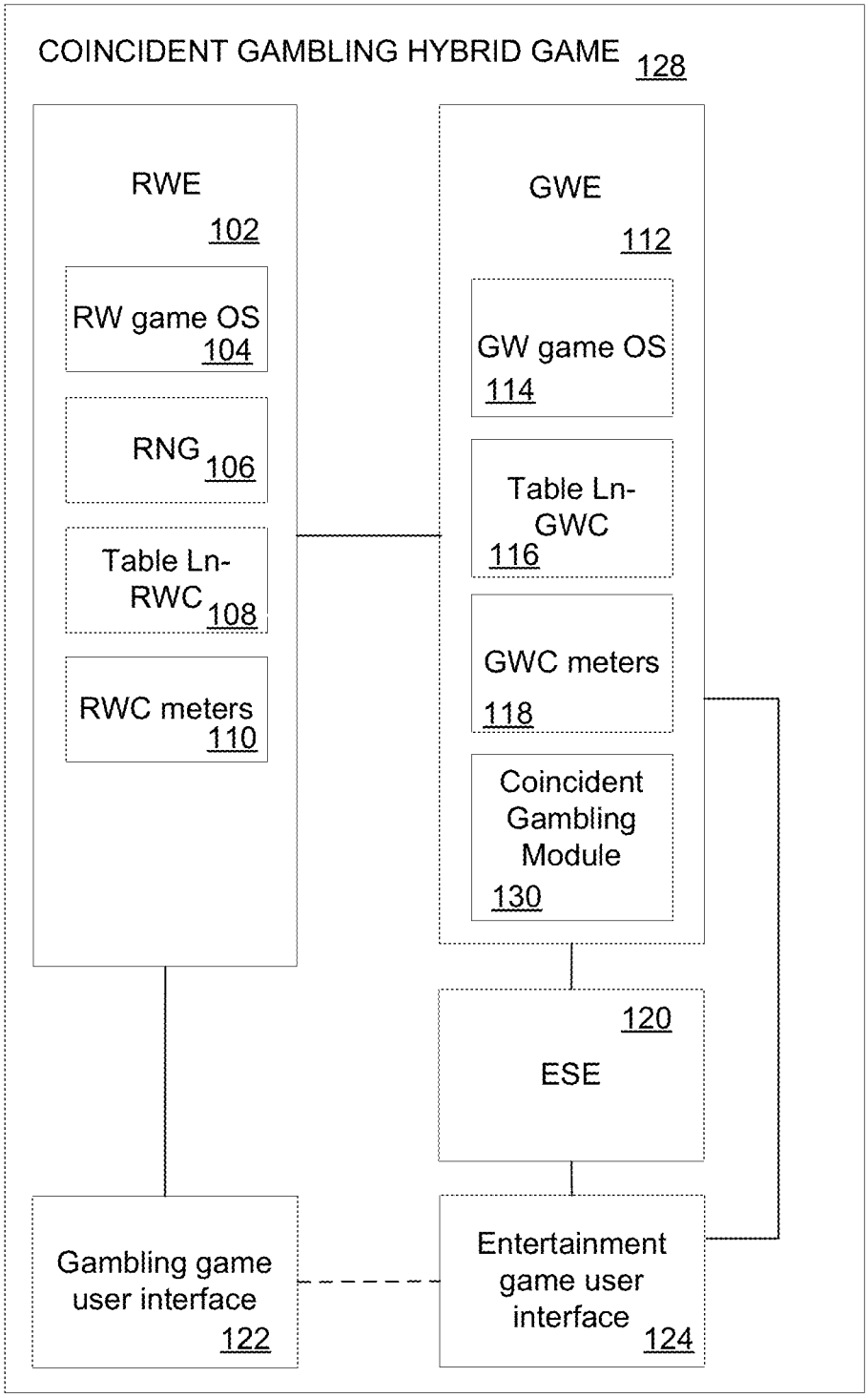
FIG. 1 illustrates a conceptual diagram of components of a coincident gambling hybrid game in accordance with an embodiment of the invention.

In accordance with many embodiments of the invention, a coincident gambling hybrid game integrates high-levels of entertainment content with a game of skill (entertainment game) and a gambling experience with a game of chance (gambling event). A coincident gambling hybrid game provides for random outcomes independently of player skill while providing that the player's gaming experience (as measured by obstacles/challenges encountered, time of play and other factors) is shaped by the player's skill. The outcome of a gambling event is determined on the partial basis of a random outcome of random number information generated by a Random Number Generator (RNG) or other such device that provides random number information generated from a source of random numbers or from a pseudo random number generation process. Once the random outcome has been determined, it may be used in conjunction with a paytable to determine how many real world credits a player has won based on the random outcome. In accordance with some embodiments, the gambling event may be initiated in response to a game object related player action. A coincident gambling hybrid game in accordance with an embodiment of the invention is illustrated in FIG. 1. The coincident gambling hybrid game 128 includes a Real World Engine (RWE) 102, a Game World Engine (GWE) 112, an Entertainment System Engine (ESE) 120, a gambling game player interface 122 and an entertainment game player interface 124. The two player interfaces can be part of the same player interface but are separate in the illustrated embodiment. The RWE 102 is connected with the GWE 112 and the gambling game player interface 122. The ESE 120 is connected with the GWE 112 and the entertainment game player interface 124. The GWE 112 is connected also with the entertainment game player interface 124.

In accordance with several embodiments, the RWE 102 is an operating system for the gambling game of the coincident gambling hybrid game 128 and controls and operates the gambling game. The operation of a gambling game is enabled by Real World Currency (RWC), such as money or other real world funds. A gambling game can increase or decrease an amount of RWC based on random gambling outcomes, where the gambling proposition of a gambling event is typically regulated by gaming control bodies. In many embodiments, the RWE includes a Real World (RW) operating system (OS) 104, RNG 106, level n real-world credit pay tables (table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (table Ln-RWC) 108 is a table that can be used in conjunction with a random number generator (RNG) 106 to dictate the RWC earned as a function of sponsored gameplay and is analogous to the pay tables used in a conventional slot machine. Table Ln-RWC payouts are independent of player skill. There can be one table or multiple tables included in Ln-RWC pay tables 108 contained in a gambling game, the selection of which can be determined by factors including (but not limited to) game progress that a player has earned, and/or bonus rounds for which a player can be eligible. RWCs are credits analogous to slot machine game credits, which are entered into a gambling game by the player, either in the form of money such as hard currency or electronic funds. RWCs can be decremented or augmented based on the outcome of a random number generator according to the table Ln-RWC real world credits pay table 108, independent of player skill. In certain embodiments, an amount of RWC can be used as criteria in order to enter higher ESE game levels. RWC can be carried forward to higher game levels or paid out if a cash out is opted for by a player. The amount of RWC used to enter a specific level of the game level n need not be the same for each level.

In accordance with some embodiments, the GWE 112 manages the overall coincident gambling hybrid game operation, with the RWE 102 and the ESE 120 effectively being support units to the GWE 112. In accordance with some of these embodiments, the GWE 112 contains mechanical, electronic, and software systems for an entertainment game. The GWE 112 includes an operating system (OS) 114 that provides control of the entertainment game. The GWE additionally contains a level n game world credit pay table (table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE). The GWE additionally contains various audit logs and activity meters (such as the GWC meter) 118. The GWE 112 can also couple to a centralized server for exchanging various data related to the player and their activities on the game. The GWE 112 furthermore couples to the ESE 120. In some embodiments, the GWE includes a coincident gambling module 130 to facilitate implementation of a coincident gambling hybrid game as described herein.

In accordance with some embodiments, a level n game world credit pay table (Table Ln-GWC) 116 dictates the Game World Credit (GWC) earned as a function of player skill in the nth level of the game. The payouts governed by this table are dependent upon player skill and sponsored gameplay at large and can or cannot be coupled to a RNG. In accordance with some embodiments, GWCs are player points earned or depleted as a function of player skill, specifically as a function of player performance in the context of the game. GWC is analogous to the score in a typical video game. Each entertainment game has one or more scoring criterion, embedded within the table Ln-GWC 116 that reflects player performance against the goal(s) of the game. GWCs can be carried forward from one level of sponsored gameplay to another, and ultimately paid out in various manners such as directly in cash, or indirectly such as by earning entrance into a sweepstakes drawing, or earning participation in, or victory in, a tournament with prizes. GWCs can be stored on a player tracking card or in a network-based player tracking system, where the GWCs are attributed to a specific player.

In accordance with certain embodiments, the operation of the GWE does not affect the RWE's gambling operation except for player choice parameters that are allowable in slot machines, including but not limited to, wager terms such as, but not limited to, a wager amount, how fast the player wants to play (by pressing a button or pulling the handle of a slot machine), and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's player interface directly, as this can be utilized to communicate certain entertainment game club points, player status, control the selection of choices and messages which a player can find useful in order to adjust the entertainment game experience or understand their gambling status in the RWE 102.

In accordance with various embodiments of the invention, the ESE 120 manages and controls the visual, audio, and player control for the entertainment game. In accordance with certain embodiments, the ESE 120 accepts input from a player through a set of hand controls, and/or head, gesture, and/or eye tracking systems and outputs video, audio and/or other sensory output to a player interface. In accordance with many embodiments, the ESE 120 can exchange data with and accept control information from the GWE 112. In accordance with some of these embodiments, an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Wash.) running a specific entertainment game software program. In accordance with some of these embodiments, ESE 120 can be an electromechanical game system of a draw certificate based coincident gambling hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 can send certain entertainment game control parameters and elements to the ESE 120 to affect its play, such as (but not limited to) what level of character to be using, changing the difficulty level of the game, changing the type of gun or car in use, and/or requesting portion to become available or to be found by the character. These game control parameters and elements can be based on a gambling outcome of a gambling game that was triggered by an element in the entertainment game being acted upon by the player. The ESE 120 can accept this input from the GWE 112, make adjustments, and continue entertainment game gameplay all the while running seamlessly from the player's perspective. The ESE's operation is mostly skill based, except for where the ESE's processes can inject complexities into the game by chance in its normal operation to create unpredictability in the entertainment game. Utilizing this interface, the ESE 120 can also communicate player choices made in the game to the GWE 112, such as but not limited to selection of a different gun, and/or the player picking up a special portion in the GW environment. The GWE's function in this architecture, being interfaced with the ESE 120, is to allow the transparent coupling of entertainment software to a fair and transparent random chance gambling game, providing a seamless perspective to the player that they are playing a typical popular entertainment game (which is skill based). In accordance with certain embodiments, the ESE 120 can be used to enable a wide range of entertainment games including but not limited to popular titles from arcade and home video games, such as but not limited to Gears of War (a third person shooter game developed by Epic Games of Cary, N.C.), Time Crisis (a shooter arcade game developed by Namco Ltd of Tokyo, Japan), or Madden Football (an American football video game developed by EA Tiburon of Maitland, Fla.). Providers of such software can provide the previously described interface by which the GWE 120 can request amendments to the operation of the ESE software in order to provide seamless and sensible operation as both a gambling game and an entertainment game.

In accordance with some embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of gambling games per minute the RWE 102 can execute, entrance into a bonus round, and other factors, all the while these factors can take a different form than that of a typical slot machine. An example of a varying wager amount that the player can choose can include, but is not limited to, gameplay with a more powerful character, a more powerful gun, or a better car. These choices can increase or decrease the amount wagered per individual gambling game, in the same manner that a standard slot machine player can decide to wager more or less credits for each pull of the handle. In accordance with some of these embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In accordance with a particular embodiment, the RWE 102 operation can be a game of chance as a gambling game running every 10 seconds where the amount wagered is communicated from the GWE 112 as a function of choices the player makes in the operation profile in the entertainment game.

In many embodiments, a coincident gambling hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time, a rich environment of rewards to stimulate gamers can be established with the entertainment game. In accordance with some of these embodiments, the coincident gambling hybrid game can leverage very popular titles with gamers and provides a sea change environment for casinos to attract players with games that are more akin to the type of entertainment that a younger generation desires. In accordance with various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In accordance with some embodiments, coincident gambling hybrid games also allow players to gain entry into subsequent competitions through the accumulation of game world credits (GWC) as a function of the player's demonstrated skill at the game. These competitions can pit individual players or groups of players against one another and/or against the casino to win prizes based upon a combination of chance and skill. These competitions can be either asynchronous events, whereby players participate at a time and/or place of their choosing, or they can be synchronized events, whereby players participate at a specific time and/or venue.

In accordance with some embodiments, one or more players engage in playing an entertainment game, resident in the ESE, the outcomes of which are dependent at least in part on skill. The coincident gambling hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
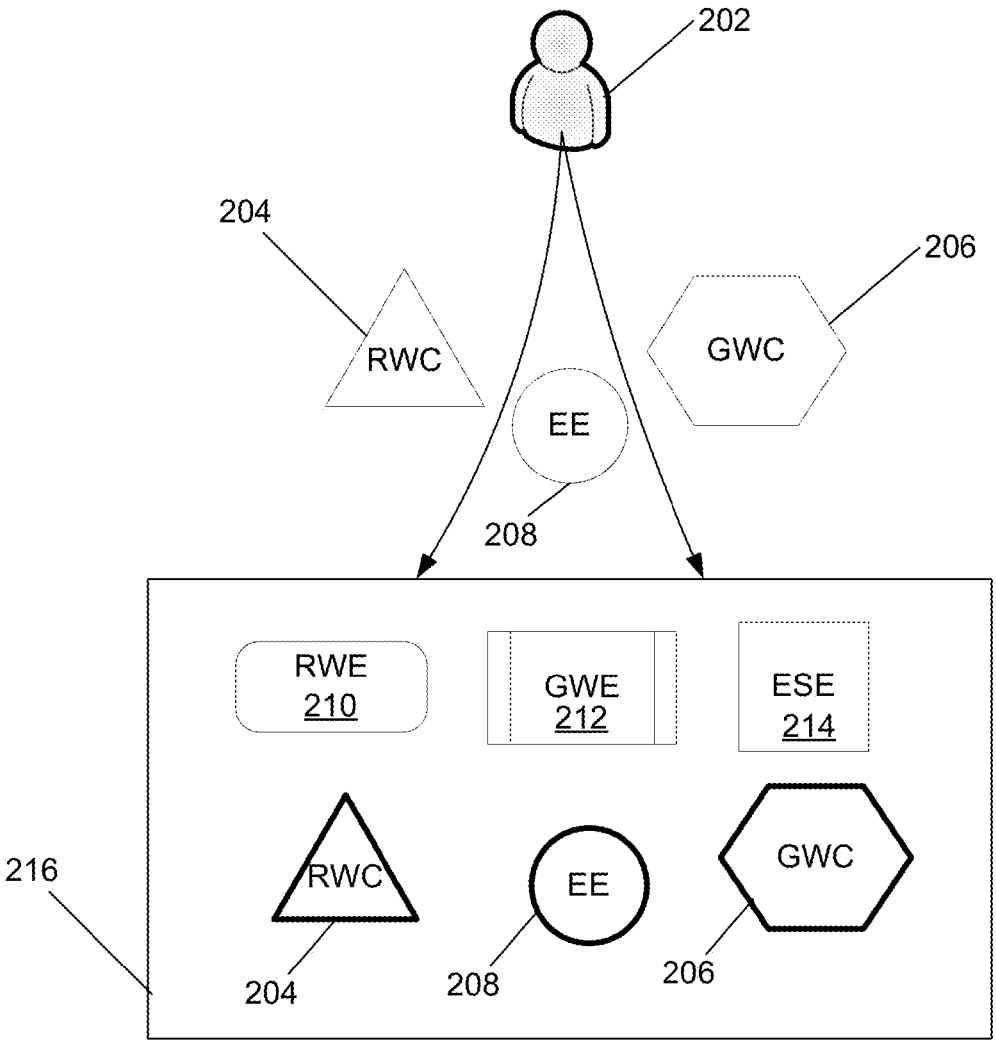
FIG. 2 is a system diagram that illustrates an implementation of a network distributed coincident gambling hybrid game including a game world engine local server in accordance with an embodiment of the invention.

In accordance with some embodiments, a player can interact with a coincident gambling hybrid game by using RWC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RWC and elements, such as but not limited to Entertainment Elements (EE), are utilized in a coincident gambling hybrid game in accordance with an embodiment of the invention is illustrated in FIG. 2. The conceptual diagram illustrates that RWC 204, EE 208 and GWC 206 can be utilized by a player 202 in interactions with the RWE 210, GWE 212 and ESE 214 of a draw certificate based coincident gambling hybrid game 216. The contribution of elements, such as EE 208, can be linked to a player's access to credits, such as RWC 204 or GWC 206. Electronic receipt of these credits can come via a smart card, voucher or other portable media, or as received over a network from a server. In accordance with certain embodiments, these credits can be drawn on demand from a player profile located in a database locally on a coincident gambling hybrid game or in a remote server.

Figure 3:
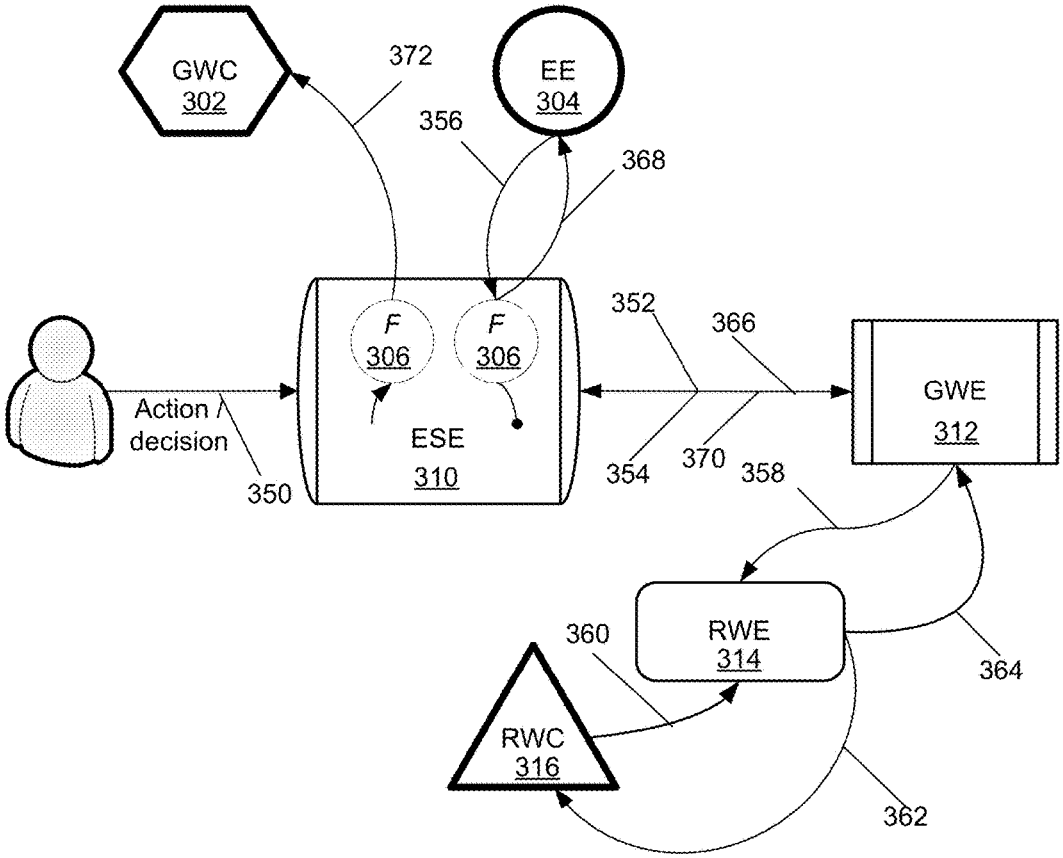
FIG. 3 illustrates a representative state diagram that illustrates an implementation of a network distributed coincident gambling hybrid game in accordance with an embodiment of the invention.

A conceptual diagram that illustrates interplay between elements and components of a coincident gambling hybrid game in accordance with an embodiment of the invention is illustrated in FIG. 3. Similar to FIG. 2, a player's actions and/or decisions can affect functions 306 that consume and/or accumulate GWC 302 and/or EE 304 in an entertainment game executed by an ESE 310. A GWE 312 can monitor the activities taking place within an entertainment game executed by an ESE 310 for gameplay gambling event occurrences. The GWE 312 can also communicate the gameplay gambling event occurrences to an RWE 314 that triggers a wager of RWC 316 in a gambling game executed by the RWE 314.

In accordance with some embodiments of the invention, the following may occur during use of the coincident gambling hybrid game. The player enters an input that represents an action or decision (350). The ESE 310 signals the GWE 312 with the input decision or action (352). The GWE 312 responds by signaling to ESE 310 with the amount of EE that is consumed by the player action or decision (354). The signaling from the GWE 312 configures a function 306 to control the EE consumption, decay, and/or accumulation.

The ESE 310 then adjusts the EE 304 accordingly (356). The GWE 312 signals the RWE 314 as to the profile of the wager proposition associated with the action or decision and triggers the wager (358). The RWE 314 consumes the appropriate amount of RC 316 and executes the wager (360). The RWE 314 then adjusts the RC 316 based upon the outcome of the wager (362) and informs the GWE 312 as to the outcome of the wager (364).

The GWE 312 signals the ESE 310 to adjust EE to one or more of the EEs of the ESE entertainment game (366). Function 306 of the ESE 310 performs the adjustment of EE 304 (368). The ESE 310 signals the GWE 312 as to the updated status (370). In response, the GWE 312 signals the ESE 310 to update GWC of the entertainment game. The ESE updates the GWC using a function 306 (372).

The following is an example of the above flow in a first person shooter game, such a Call of Duty®, using a coincident gambling hybrid game sequence in accordance with embodiments of the invention.

The process begins by a player selecting a machine gun to use in the game and then fires a burst of bullets at an opponent (350). The ESE 310 signals the GWE 312 of the player's choice of weapon, that a burst of bullets was fired, and the outcome of the burst (352). GWE 312 processes the information received and signals ESE 310 to consume 3 bullets (EE) with each pull of the trigger (354). The ESE 310 consumes 3 bullets for the burst using function 306 (356).

The GWE 312 signals the RWE 314 that 3 credits (RC) are to be wagered to match the three bullets consumed. The RWE 314 then obtains a draw certificate from a draw server or the like as discussed further below and determines the result of the wager and may determine the winnings from a pay table. On a particular pay table (Table Ln-RC), a determination is made by RWE 314 as to the amount of damage that the opponent has sustained. The RWE 314 consumes 3 credits of RC 316 for the wager and executes the specified wager (360). The RWE 314 determines that the player hit a jackpot of 6 credits and returns the 6 credits to the RC 316 (362) and signals the GWE 312 that 3 net credits were won by the player (364).

The GWE 312 signals ESE 310 to add 3 bullets to an ammunition clip (366). ESE 310 adds 3 bullets back to the ammo clip (EE 304) using a function 306 (368). The ammunition may be added by directly adding the ammunition to the clip or by allowing the player to find extra ammunition during game play. The GWE 312 logs the new player score (GWC 302) in the game (as a function of the successful hit on the opponent) based on the ESE 310 signaling, and the signals the ESE 310 to add 2 extra points to the player score since a jackpot has been won (370). The ESE 310 then adds 10 points to the player score (GWC 302) given the success of the hit which in this example is worth 8 points, plus the 2 extra points requested by GWE 312 (372). Note that the foregoing example is only intended to provide an illustration of how credits flow in a coincident gambling hybrid game, but is not intended to be exhaustive and only lists only one of numerous possibilities of how a coincident gambling hybrid game may be configured to manage its fundamental credits.

Network Based Coincident Gambling Hybrid Game

Figure 4:
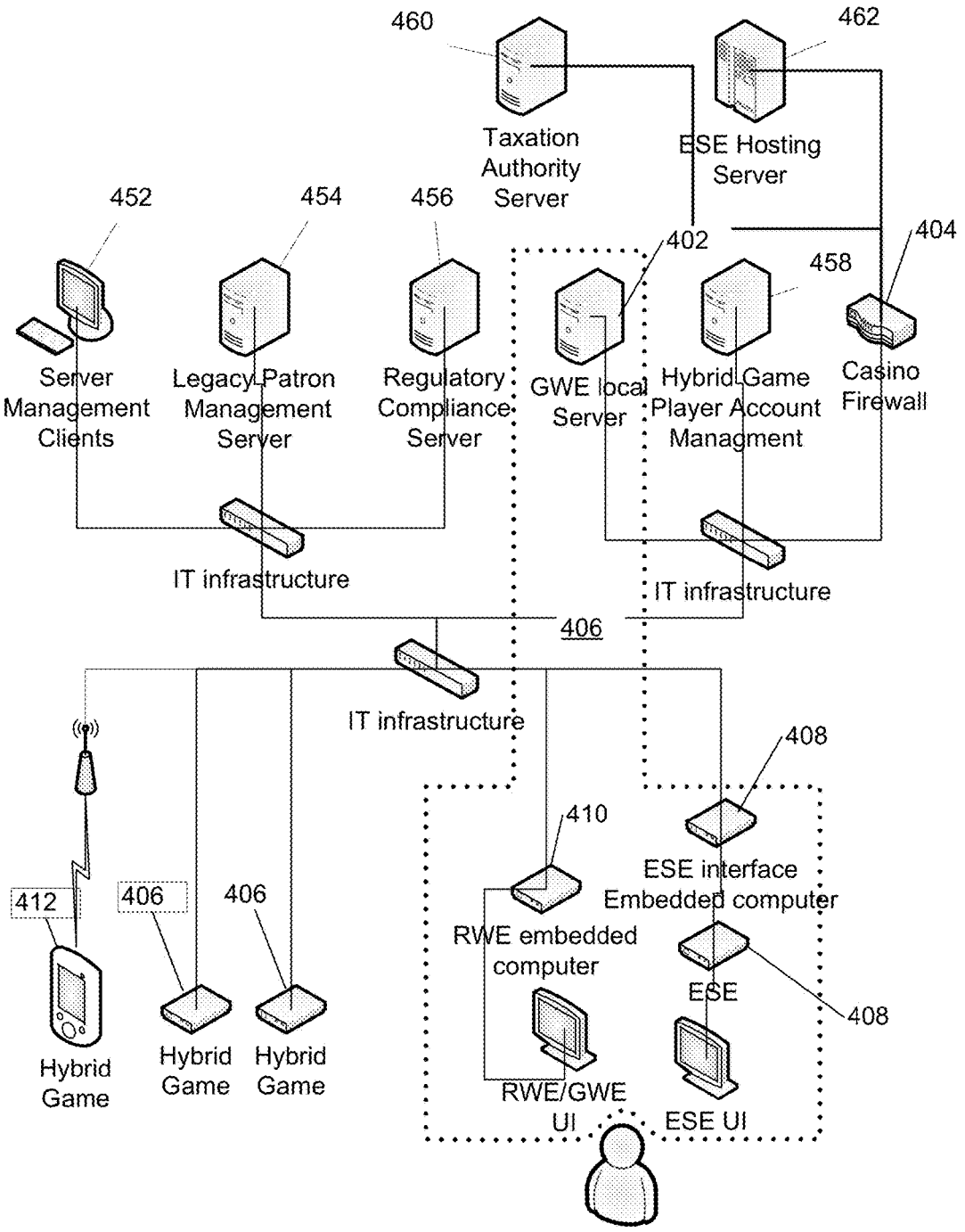
FIG. 4 illustrates a system diagram of an implementation of a network based coincident gambling hybrid game in accordance with an embodiment of the invention.

A system diagram that illustrates an implementation of a network distributed coincident gambling hybrid game with a GWE local server in accordance with embodiments of the invention is illustrated in FIG. 4. The system includes several coincident gambling hybrid games 406 sharing services from the same GWE local server 402 over a network. The system includes several coincident gambling hybrid games 406 sharing services from the same GWE local server 402 over a network. Coincident gambling hybrid game 412 is a particular implementation where the coincident gambling hybrid game is implemented on a mobile device connected to the network via a wireless connection. The remaining coincident gambling hybrid games 406 can be implemented on any device, including laptops, desktop computers, mobile phones, tablets or the like over a network connection. A single coincident gambling hybrid game 406 with a RWE 410, ESE 408 and GWE 402 is enclosed within a dotted line. A number of other peripheral systems, such as, but not limited to, legacy patron management server 452, client management server 454, regulatory compliance server 456, and hybrid game player account management server 458 can also interface with the game object coincident gambling hybrid games over a network within an operator's firewall 804. Other servers can reside outside the bounds of a network within an operator's firewall 404 to provide additional services for network connected game object coincident gambling hybrid games. Examples of such servers, include, but are not limited to taxation authority server 460 and ESE hosting server 462. One skilled in the art will recognize that although these systems are represented as one server that one or more connected servers or other processing systems may provide the same function without departing from this invention.

Figure 5:
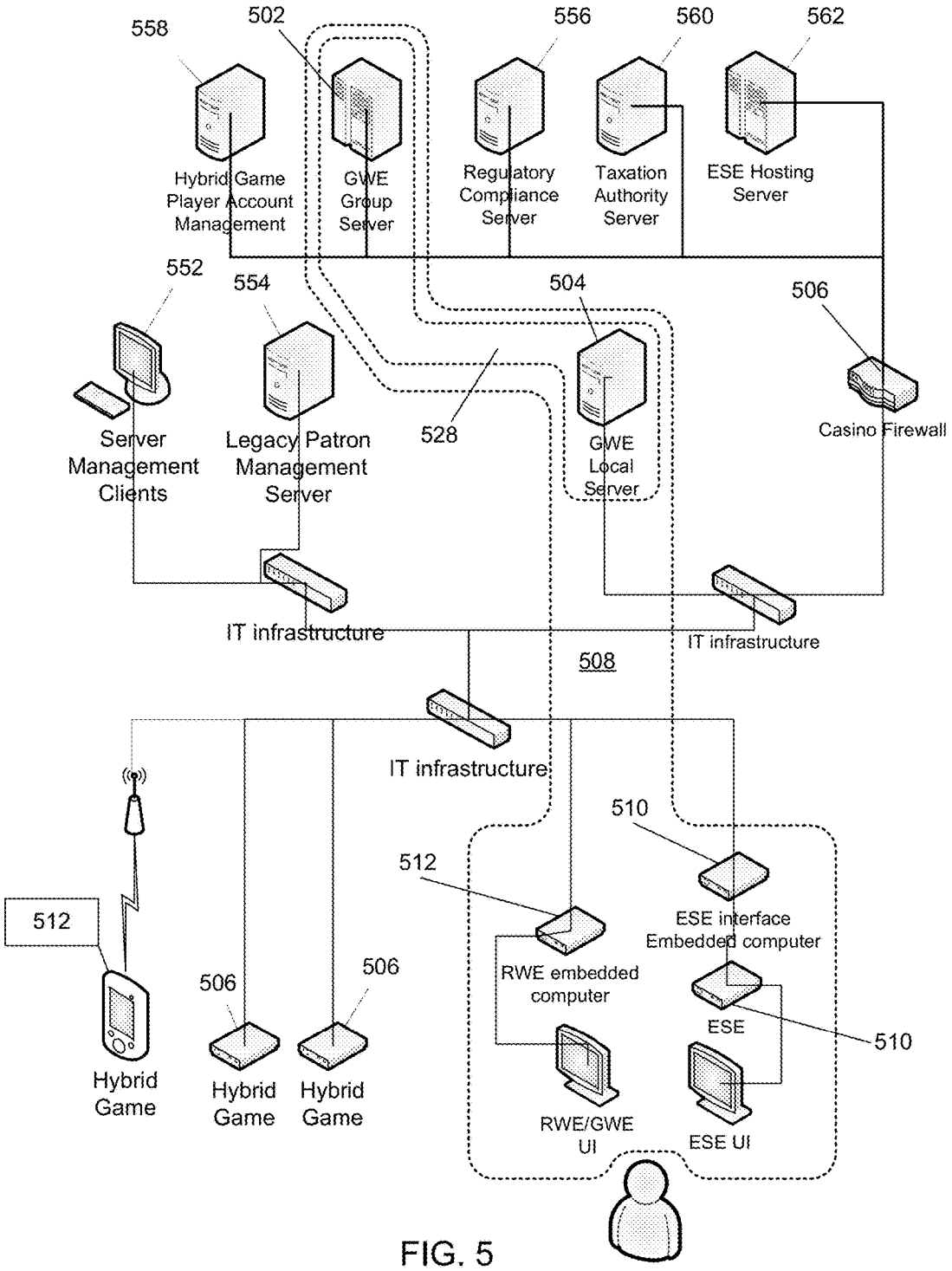
FIG. 5 illustrates a system diagram of an implementation of a network based coincident gambling hybrid game in accordance with another embodiment of the invention.

A system diagram that illustrates an implementation of a network distributed hybrid game with a GWE local server and a GWE group server in accordance with embodiments of the invention is illustrated in FIG. 5. The system includes several coincident gambling hybrid games 506 sharing services from the same GWE local server 528 over a network. Coincident gambling hybrid game 512 is a particular implementation where the coincident gambling hybrid game is implemented on a mobile device connected to the network via a wireless connection. The remaining coincident gambling hybrid games 506 can be implemented on any device, including laptops, desktop computers, mobile phones, tablets or the like over a network connection. A single coincident gambling hybrid game 506 with a RWE 510, ESE 508 and GWE 528 is enclosed within a dotted line. This system includes a coincident gambling hybrid game 508 that includes a RWE 512, ESE 510 and GWE local server 504 as shown enclosed within a dotted line but where a single coincident gambling hybrid game can call upon services from servers within an operator's firewall 506 (such as, but not limited to, a GWE local server 504) as well as beyond an operator's firewall 506 (such as, but not limited to, a GWE group server 502). The GWE group server 502 can coordinate multiple coincident gambling hybrid games from across a network that spans beyond an operator's firewall 506. A GWE server system 518 can include multiple GWE servers, such as, but not limited to, a GWE local server 504 and a GWE group server 502. Multiple network connected hybrid games 506 can be connected to various servers to call upon services that enable the execution of the hybrid game. These servers include but are not limited to client management server 552 and legacy patron management server 554 within the casino firewall 506; and regulatory compliance server 556, hybrid game account management server 558, taxation authority server 560 and ESE hosting server 562 outside the casino firewall 506. One skilled in the art will recognize that servers may be single servers or a group of servers and processing systems providing the services without departing from this invention; and that the servers described may be within or outside of casino firewall 506 without departing from this invention.

Figure 6:
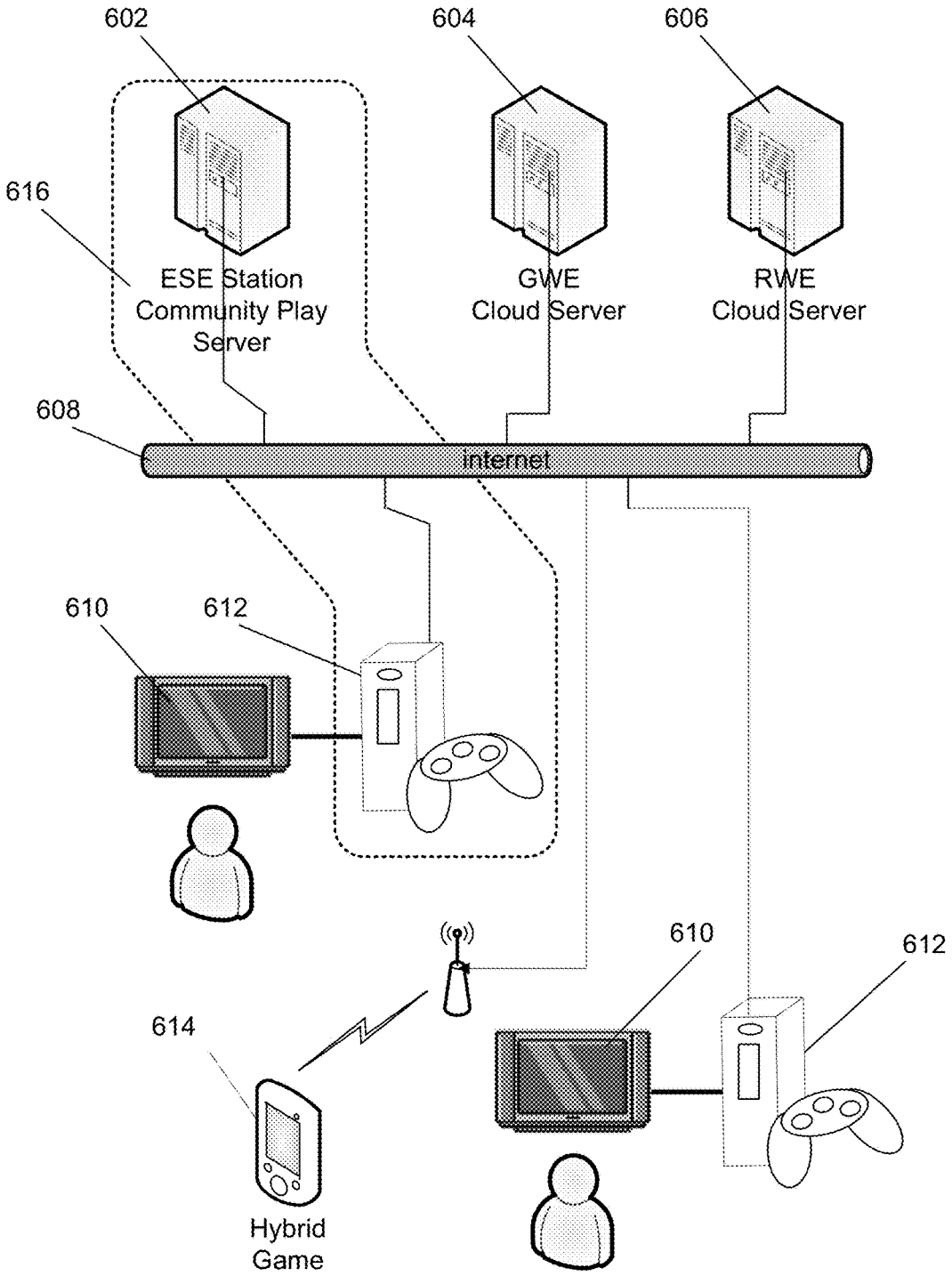
FIG. 6 illustrates a system diagram of an implementation of an Internet based coincident gambling hybrid game in accordance with an embodiment of the invention.

A system diagram that illustrates an implementation of network distributed hybrid games over the Internet in accordance with an embodiment of the invention is illustrated in FIG. 6. The system includes an ESE server 602, GWE server 604 and RWE server 606 that each connect to a player interface 610 (such as, but not limited to, a television screen, computer terminal, tablet, touchscreen or PDA) of game object coincident gambling hybrid games over the Internet 608. Each coincident gambling hybrid game includes a local ESE 612 (such as, but not limited to, a video game console or a gaming computer system) that interfaces with a remote ESE server 602. Processes performed by an ESE 616 services can be performed in multiple locations, such as, but not limited to, remotely on an ESE server 602 and locally on a local ESE 612. In addition, a coincident gambling hybrid game may include a Personal Digital Assistant (PDA) 614 or other type of mobile computing device game coupled to the ESE hosting server 602, thus providing the opportunity for a player to play a hybrid game on the PDA through a mobile phone or data network.

There are many possible permutations of the architecture of systems for providing a coincident gambling hybrid game in accordance with embodiments of the invention. FIGS. 4-6 show only three possible permutations and are provided as examples which are not intended to suggest limitations to the forms of the architecture. Other permutations might include a version where the entire coincident gambling hybrid game is in the cloud with only a client running on player terminal within the bounds of the casino, or a permutation where the RWE and GWE are casino bound and the ESE exists in the cloud, accessed by a client running on a terminal in the casino.

Processing Apparatuses

Figure 7:
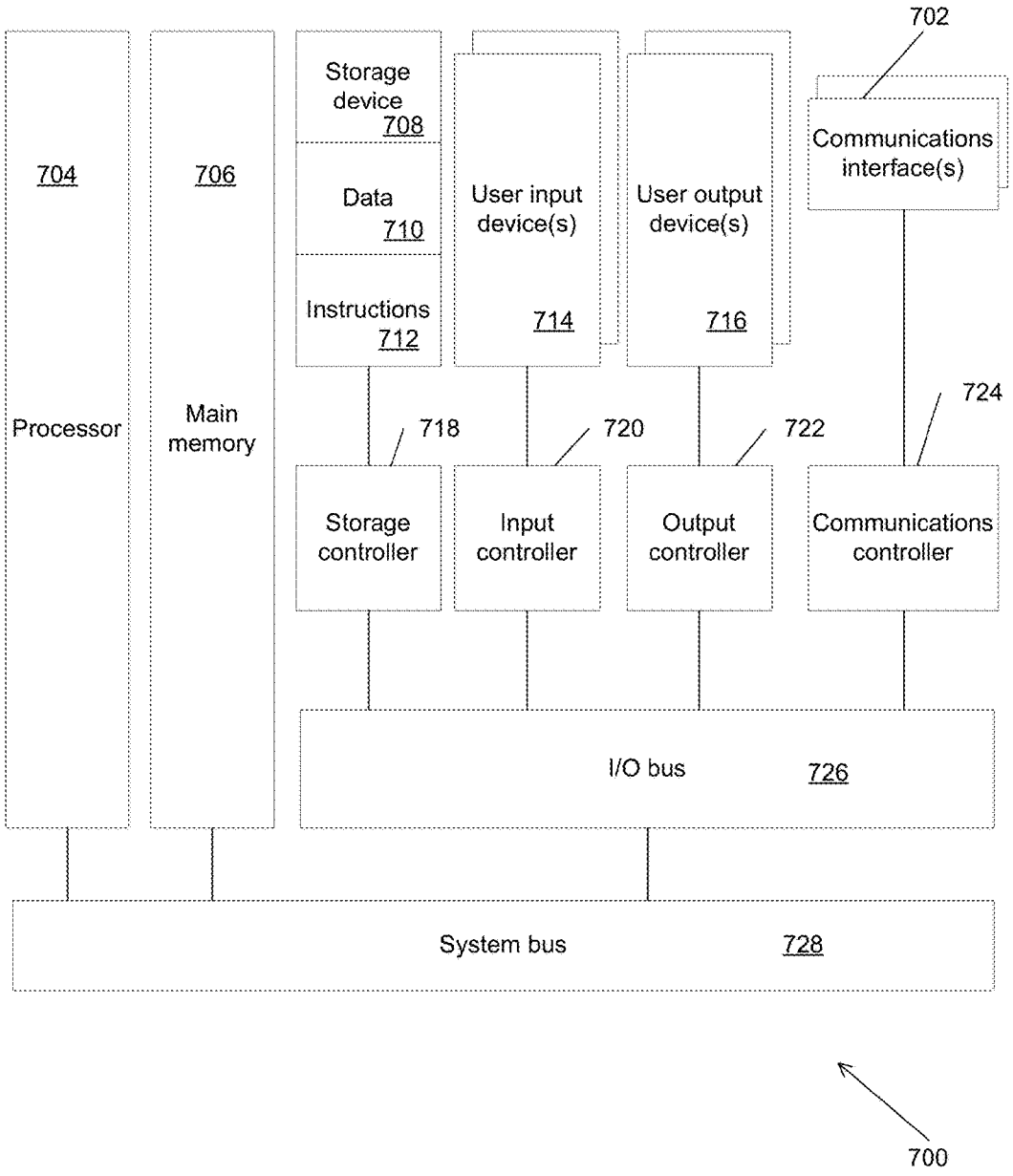
FIG. 7 illustrates a block diagram of components of a device implementing a coincident gambling hybrid game in accordance with an embodiment of the invention.

Any of a variety of processing apparatuses can host various components of a coincident gambling hybrid game in accordance with embodiments of the invention. In accordance with embodiments of the invention, these processing apparatuses can include, but are not limited to, a gaming machine, a general purpose computer, a computing device and/or a controller. A processing apparatus that is constructed to implement a coincident gambling hybrid game in accordance with embodiments of the invention is illustrated in FIG. 7. In the processing apparatus 700, a processor 704 is coupled to a memory 706 by a bus 728. The processor 704 is also coupled to non-transitory processor-readable storage media, such as a storage device 708 that stores processor-executable instructions 712 and data 710 through the system bus 728 to an I/O bus 726 through a storage controller 718. The processor 704 is also coupled to one or more interfaces that can be used to connect the processor to other processing apparatuses as well as networks as described herein. The processor 704 is also coupled via the bus to player input devices 714, such as tactile devices including, but not limited to, keyboards, keypads, foot pads, touch screens, and/or trackballs; as well as non-contact devices such as audio input devices, motion sensors and motion capture devices that the processing apparatus can use to receive inputs from a player when the player interacts with the processing apparatus. The processor 704 is connected to these player input devices 714 through the system bus 728, to the I/O bus 726 and through the input controller 720. The processor 704 is also coupled via the bus to player output devices 716 such as (but not limited to) visual output devices, audio output devices, and/or tactile output devices that the processing apparatus uses to generate outputs perceivable by the player when the player interacts with the processing apparatus. In accordance with some embodiments, the processor is coupled to visual output devices such as (but not limited to) display screens, light panels, and/or lighted displays. In accordance with particular embodiments, the processor is coupled to audio output devices such as (but not limited to) speakers, and/or sound amplifiers. In accordance with many of these embodiments, the processor 704 is coupled to tactile output devices like vibrators, and/or manipulators. The processor 704 is connected to output devices from the system bus 728 to the I/O bus 726 and through the output controller 722. The processor 704 can also be connected to a communications interface 702 from the system bus 728 to the I/O bus 726 through a communications controller 724.

In accordance with various embodiments, a processor 704 can load instructions and data from the storage device into the memory 706. The processor 704 can also execute instructions that operate on the data to implement various aspects and features of the components of a coincident gambling hybrid game. The processor 704 can utilize various input and output devices in accordance with the instructions and the data in order to create and operate player interfaces for players or operators of a coincident gambling hybrid game (such as but not limited to a casino that hosts the coincident gambling hybrid game).

Although the processing apparatus 700 is described herein as being constructed from a processor and instructions stored and executed by hardware components, the processing apparatus can be composed of only hardware components in accordance with other embodiments. In addition, although the storage device is described as being coupled to the processor through a bus, those skilled in the art of processing apparatuses will understand that the storage device can include removable media such as, but not limited to, a USB memory device, an optical CD ROM, magnetic media such as tape and disks. Also, the storage device can be accessed by processor 704 through one of the interfaces or over a network. Furthermore, any of the player input devices or player output devices can be coupled to the processor 704 via one of the interfaces or over a network. In addition, although a single processor 704 is described, those skilled in the art will understand that the processor 704 can be a controller or other computing device or a separate computer as well as be composed of multiple processors or computing devices.

Coincident Gambling Event and Game Event

In accordance with many embodiments of the invention, an action in an entertainment game may trigger a gambling event that has a wager result and an effect on one or more variables in the entertainment game. In a specific instance, a gambling event is triggered by an actionable element, and feedback from the result of the gambling game. An overview of a process for providing a gambling event triggered by an action in the entertainment game that has a wager result and affects one or more variables in an entertainment game in accordance with embodiments of the invention is illustrated in FIG. 8.

Figure 8:
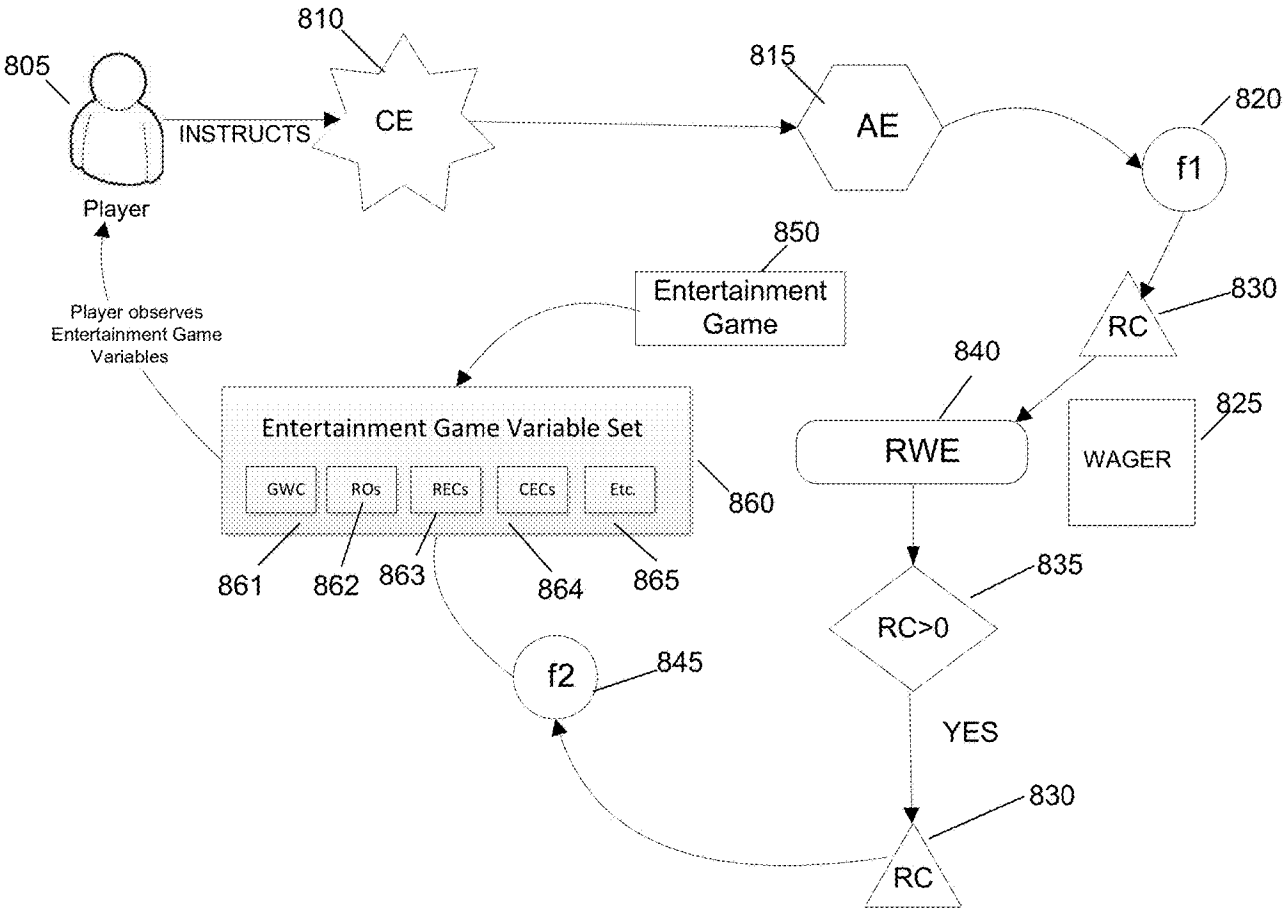
FIG. 8 illustrates a conceptual diagram of the interaction between components for a system providing a coincident gambling hybrid game having coincident gambling and game events in accordance with embodiments of the invention.

In FIG. 8, a player 805 enters an input directing a controllable element 810 to perform an action event 815. The action event 815 is provided to a function 820, f1, which determines the AE triggers a gambling event. The gambling event includes a wager 825 of Real World Credits (RWC or RC) 830. The RWE 840 is informed of the gambling event and may determine whether the player has sufficient RC for the wager (835). If the player has sufficient funds for the wager, RWE 840 generates the outcome of the gambling event. The result of the gambling game is provided to a function 845, f2, which determines the effects of the result on one or more variables within the Entertainment Game Variable Set 860. Thus, the changes to the variables in the Entertainment Game Variable Set 860 are provided to the ESE 850. The ESE 850 uses the result 845 of gambling event outcome to change variables 861-865 of an entertainment game variable set 860. The variables are observable to various degrees by the player and affect his (or his CE or agent's) interaction with the game. The player then observes the game state as a result of the change of the variables and acts accordingly. Thus, a closed-loop is created for the process.

The following is an example of the process in an adventure game using the process described with reference to FIG. 8. A player 805 enters an input that causes the player's CE 810 to open a door (AE 815). The opening of the door (AE 815) is provided to f1 that determines that the opening of the door triggers a gambling event 820. The result of the gambling event is then provided to f2 that determines that the result of the gambling event in addition to affecting the ESE 850 also affects the CE's characteristics (e.g. health or dexterity) and/or the contents of the room (e.g. the number of monsters or the amount of treasure therein). This example is illustrative only and not all encompassing. There are many other structures described previously that may include EE, CEE, and other elements, the contents of which are incorporated by reference herein. The absence of these elements is not meant, in any way, to indicate that the concepts discussed in this disclosure are not compatible with these other hybrid game aspects.

Figure 9:
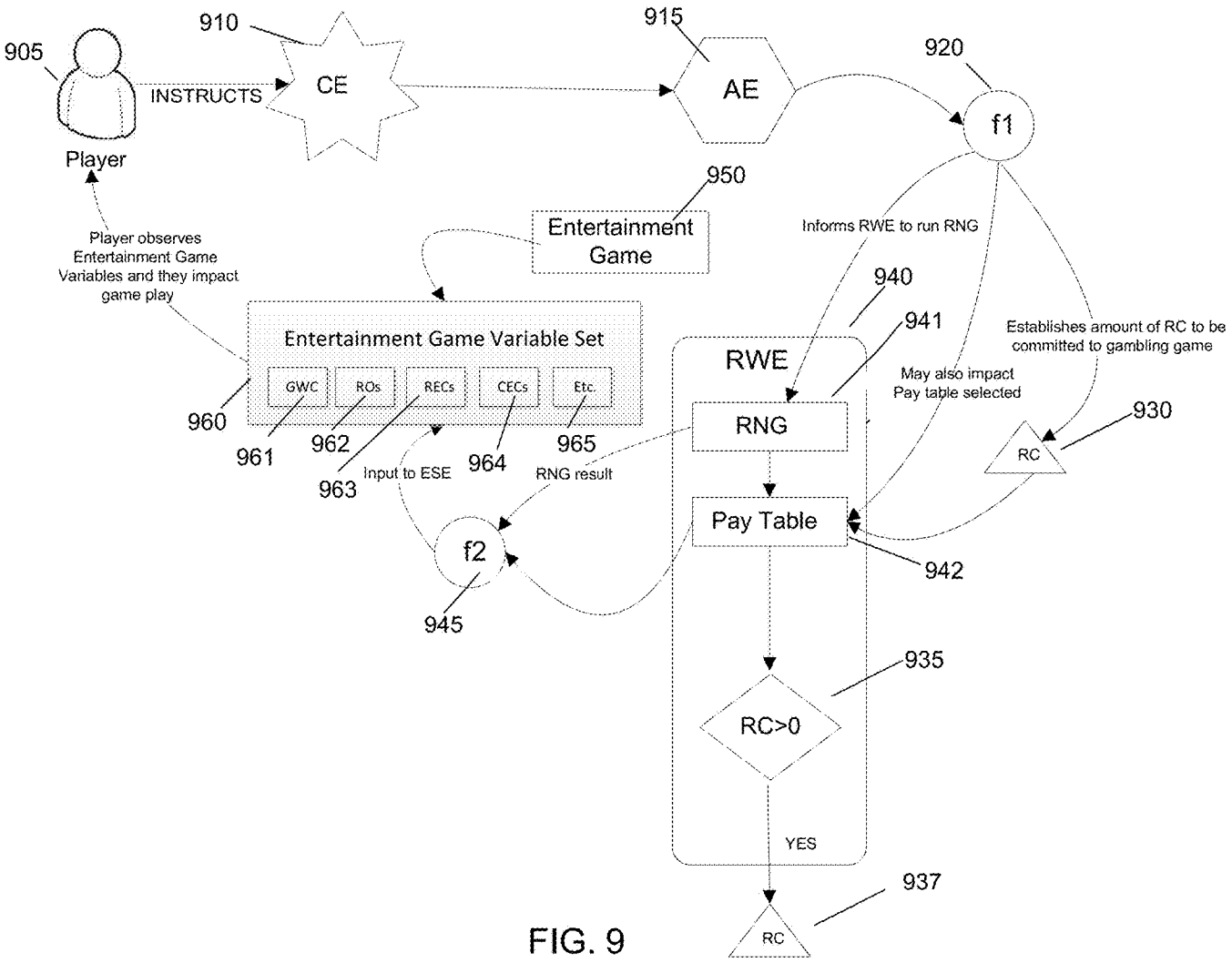
FIG. 9 illustrates a conceptual diagram of the interaction between components for a system providing a coincident gambling hybrid game having coincident gambling and game events in accordance with other embodiments of the invention.

In accordance with some embodiments of the invention, the AE triggers a RNG, which then feeds a process that dictates a gambling game result and at the same time triggers a process that affects one or more variables within the entertainment game. A process for providing the results of a gambling event determined by a random number generated using an RNG in accordance with embodiments of the invention is shown in FIG. 9. In the process shown in FIG. 9, a player 905 enters an input directing a character element 910 to perform an action event 915. The AE 915 is provided to a function, f1 920 that determines whether the AE triggers a gambling event. When f1 920 determines that the AE triggers a gambling event, f1 may determine the amount of a wager of Real World Credits (RWC or RC) 930 on a gambling proposition. The RWE 940 is informed of the gambling event and may determine whether the player has sufficient RC for the wager (935). The RWE 940 uses information about f1 920 and the gambling event to determine the proper pay table to determine the results of the gambling event. If the player has sufficient funds for the wager, RWE 940 uses RNG 941 to generate a random number that is used to determine the outcome of the gambling event. In some embodiments, both the outcome of the gambling event and the random outcome generated by the RNG of the gambling game are provided to function 945, f2. The f2 945 determines whether and/or how the random outcome and the outcome of the gambling event affects one or more variables within the entertainment game variable set. The f2 945 then provides any changes to the variable to the ESE 950. The ESE 950 uses the gambling event outcome to change variables 961-965 of an entertainment game variable set 960. The variables affect various aspects of the entertainment game and these affects are observed by the player and affect the player's (or the player's CE or agent's) interaction with the game. The player then observes the game state as a result of the change of the variables and acts accordingly.

For example, consider an adventure game, akin to Dungeons and Dragons, where a player must roll a 6-sided die in the context of the game to determine if her CE hits an opponent with his sword and inflicts one health point of damage (in this context rolling a 6-sided die can refer to utilizing a RNG within a RWE to randomly select between one of six possible outcomes). If the player rolls a one or a two, the attack is successful. Roll a 3, 4, 5 or 6 and the attack is unsuccessful. The act of rolling a die also commits the player to a 1 RC bet, which provides payouts according to the following rule (i.e. the pay table): {1, 2:2 RC} {3, 4, 5, 6:0 RC}

When the player 905 directs the CE 910 to attack an opponent with his sword, which requires the rolling of a 6-sided die (the AE 915), the AE 915 provided to f1 event 920 that determines the AE initiates a gambling event. f1 920 communicates the gambling event to the RWE 940. The RWE 940 causes the RNG 941 to execute, generating an integer between one and six inclusive to determine the results of the gambling event. It also commits the specified amount of RC 930 to a wagering proposition and may or may not preclude RNG 941 operation if RC is not available in the player's account to cover the wager (935). In this example, the gambling event 920 is not parameterizing the RNG 941 or selecting between multiple RNGs as a function of the entertainment game because only a single AE (i.e. rolling of a 6-sided die to establish the results of a sword attack) is contemplated. In other aspects of the system, the function f1 of gambling event 920 may specify which RNG is to be used in addition to establishing the amount of RC committed to the gambling game.

The RNG 941 result or outcome is provided to f2 945, which interprets effects on entertainment game variables by the result. In this example, a result of {1, 2} will cause the health points of the opponent to be reduced while a result of {3, 4, 5 or 6} will not lead to a change in the opponent's health points. In both cases, a graphical representation of the player's "die roll" is displayed to the player, which the player experiences as the result of the die roll or random outcome she initiated (the AE 915).

The RNG result is also fed to the Pay Table 942, which establishes the amount of RC 937 to be paid to the player (either 0 or 2). This result affects the player's RC and is displayed to the player accordingly (937).

Success in the entertainment game does not necessarily correlate with a win in the gambling game. Using the above example, where a player must roll a 6-sided die in the context of the game to determine if her CE hits an opponent with his sword and inflicts one health point of damage. If the player rolls a one, two, or three, the attack is successful. Roll a 4, 5 or 6 and the attack is unsuccessful. The act of rolling a die also commits the player to a 1 RC bet, which provides payouts according to the following rule (i.e. the pay table): {1, 2:2 RC} {3, 4, 5, 6:0 RC}. In this case, a roll of the "three" completes the attack in the adventure game, but does not result in a RC win.

In accordance with some embodiments of the invention, more than one dice roll is included as part of a sequence within game play of the coincident gambling hybrid game. For example, in an adventure game, a player may roll a 6-sided die to establish whether or not a sword attack hits an opponent, and then a 20-sided die may be rolled to establish the amount of damage inflicted by the sword. In these instances, multiple serial die rolls (i.e. multiple AEs) are required as part of a CE action. This would constitute two cycles through the f1 loop in the processes shown in FIGS. 8 and 9 with f1 dictating a different RNG and possibly a different pay table, as well as the amount of RC contributed to the gambling game in each case. In accordance with these embodiments of the invention, the desired action includes multiple AEs that may involve a series of independent gambling events in that the RNG and pay tables are not compounded or combined as the coincident gambling hybrid game progresses. Alternatively, in other embodiments in accordance with this invention. The gambling events may be related and the pay tables may be compounded or combined based upon the results of the gambling events. As such, gambling games can be initiated in a number of ways, all foreseen as embodiments of the invention. A process for providing a series of gambling events resulting from an AE of a CE in accordance with embodiments of this is shown in FIG. 10.

Figure 10:
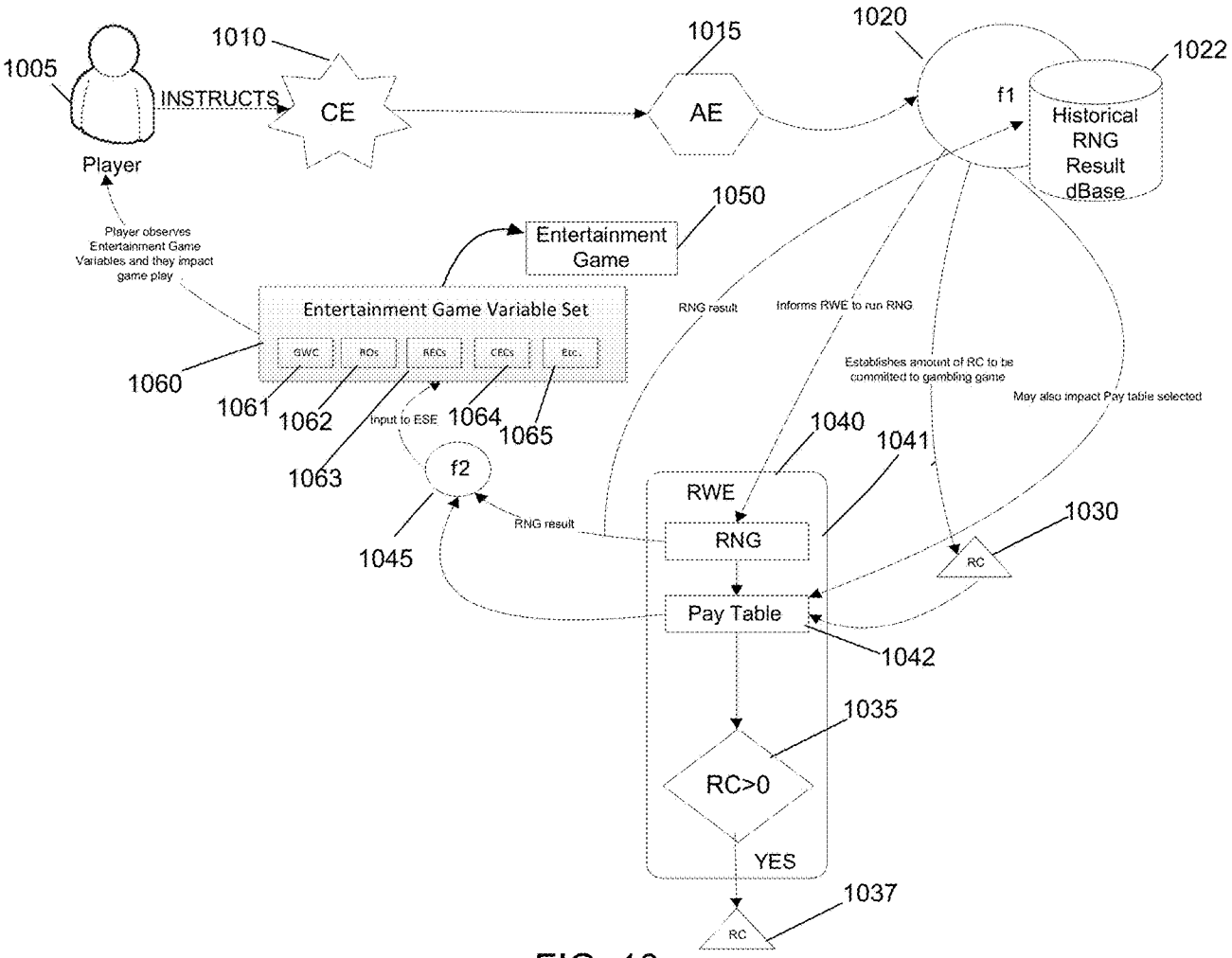
FIG. 10 illustrates a conceptual diagram of the interaction between components for a system providing a coincident gambling hybrid game having coincident gambling and game events in accordance with still other embodiments of the invention.

In the process shown in FIG. 10, a player 1005 enters an input directing a character element 1010 to perform an action event 1015. The AE 1015 is provided to a function, f1 1020 that determines whether the AE triggers a gambling event. As illustrated in FIG. 10, f1 1020 takes as an additional parameter of a previous RNG result from prior RNG events within the RWE 1040 to determine the gambling event initiated. The RNG results are stored in a database 1022 within the RWE 140 and/or the GWE and is accessible by f1 1020. The database 1022 may also store other data as part of the RNG records including, for example, but not limited to, the time stamp of the RNG results, flags related to the state of entertainment game play variables at the time the RNG was initiated, etc. The logic represented in Table 1 is generically contained within f1 1020 in the GWE in accordance with embodiments of the invention. Table 1 is illustrative but not comprehensive in that the chain of events subsumed in this system can encompass many more than two successive random events. All of these events may be independent, dependent, or a combination thereof. The random events can also relate only to entertainment game variables, only to RC, or both simultaneously

TABLE 1

| Scenario | Step 1 | Step 2 | Example 1 | Example 2 |
|---|---|---|---|---|
| 1 | First die roll or random outcome leads to initiation of gambling game, commitment of RC, payment of RC | Second die roll or random outcome leads to initiation of gambling game, commitment of RC, payment of RC independent of first roll. | In an adventure game, an attack with the sword requires a die roll. A second attack requires a new, independent die roll. Each roll initiates a gambling game. | In a football game, a play by the offense requires an RNG result to see if the pass is successful. A subsequent play requires a new, independent RNG result. Each play initiates a gambling game. |
| 2 | First die roll or random outcome leads to initiation of gambling game, commitment of RC, payment of RC | Second die leads to initiation of gambling game, which takes into account first and second die roll or random outcome results. Second die roll or random outcome leads to commitment of RC, payment of RC | In an adventure game, a player encounters a chest. The first die roll or random outcome determines the "energy cost" of opening the chest, initiating a gambling game. The second die roll or random outcome determines the contents of the chest, with the second gambling game using the RNG results from both die rolls. | In a football game, the player directs the quarterback to throw the ball. The first RNG result determines whether the ball is caught by the receiver, initiating a gambling game. The second RNG result determines how many yards are gained during the play, with the second gambling game using the RNG results from both events. |
| 3 | First die roll or random outcome leads to initiation of gambling game, commitment of RC, payment of RC | Second die roll or random outcome initiates gambling game (i.e. RNG + pay tables) but does not affect entertainment game variables. | In an adventure game, an attack with the sword requires a die roll. The first die roll or random outcome determines the entertainment game results. A second die roll or | In a game of battleship, firing a torpedo requires an RNG result. Based on the RNG, the player has either hit or missed the opposing force. A second die roll or random |

TABLE 1-continued

| Scenario | Step 1 | Step 2 | Example 1 | Example 2 |
|---|---|---|---|---|
| | | | random outcome initiates another gambling game, but does not influence the outcome of the entertainment game attack. Thus there are two gambling events and one entertainment game event. | outcome initiates another gambling event without committing the player to a move. There are two gambling events, increasing the rate of wagering, but not destabilizing the entertainment game. |
| 4 | First die roll or random outcome leads to initiation of gambling game, commitment of RC, payment of RC | Second die roll or random outcome does not initiate gambling game (i.e. RNG + pay tables), but only affects entertainment game variables via RNG | In an adventure game, an attack with the sword requires a die roll. A second roll is required to determine the amount of damage dealt by the first attack. Only the first die roll or random outcome initiates a gambling game. | In a tank battle game, an attack with a gun turret requires an RNG result. A second RNG result is required to determine how much of the tank crew's stamina is used during the attack. Only the first RNG result is factored into the gambling game. |
| 5 | First die roll or random outcome does not independently initiate a gambling game and does affect entertainment game variables. | Second die roll or random outcome leads to initiation of gambling game, commitment of RC, payment of RC independent of first roll. | In an adventure game, a player encounters a treasure chest. The first die roll or random outcome determines whether a player successfully opens the chest. This changes the entertainment game variables via RNG but does not initiate a gambling game. If the first roll is successful, the second die roll or random outcome determines the contents of the chest. The gambling game initiated by the second die roll or random outcome exists independently from the contents of the chest. | In a football game, an offensive play requires an RNG result. This changes the entertainment game variables by reducing the number of downs available, changing the yards gained, adding points to the score, switching control of the ball, or a wide variety of possible outcomes. The second RNG result initiates a gambling game and parameterizes the results of the first event. For instance, if the pass was successful from the first RNG result, the second RNG result would determine how many yards were gained. |
| 6 | First die roll or random outcome does not independently initiate a gambling game | Second die roll or random outcome leads to initiation of gambling game, which takes into account first and second die roll or random outcome results. Second die roll or random outcome leads to commitment of | In an adventure game, a player encounters a treasure chest. The first die roll or random outcome determines the contents of the chest. This changes the entertainment game variables | In a football game, an offensive play requires an RNG result. This changes the entertainment game variables by reducing the number of downs available targets, changing the yards gained, |

TABLE 1-continued

| Scenario Step 1 | Step 2 | Example 1 | Example 2 |
|---|---|---|---|
| | RC, payment of RC | via RNG but does not initiate a gambling game. The second die roll or random outcome determines whether a player successfully opens the chest. The gambling game initiated by the second die roll or random outcome takes into account both rolls; that is, the contents of the chest and the success in opening the chest are independent from each other in the entertainment game, but both RNG results influence the single gambling game. | adding points to the score, switching control of the ball, or a wide variety of possible outcomes. The second RNG result parameterizes the results of the first event. For instance, if the pass was successful from the first RNG result, the second RNG result would determine how many yards were gained. The gambling game is initiated by the second event, but takes into account both RNG results. |

When f1 1020 determines that the AE triggers a gambling event, f1 1020 may determine the amount of a wager of Real World Credits (RWC or RC) 1030 on a gambling proposition. The RWE 104040 is informed of the gambling event and may determine whether the player has sufficient RC for the wager (1035). The RWE 1040 uses information about f1 1020 and the gambling event to determine the proper pay table to determine the results of the gambling event. If the player has sufficient funds for the wager, RWE 1040 uses RNG 1041 to generate a random number that is used to determine the outcome of the gambling event. The outcome of the gambling game is provided to function 1045, f2. The f2 1045 determines whether and/or how the outcome of the gambling game affects one or more variables within the Entertainment Game Variable Set. The f2 1045 then provides any changes to the variable to the ESE 1050. The ESE 1050 uses the gambling event outcome to change variables 1061-1065 of an entertainment game variable set 1060. The variables are various degrees observed by the player and affecting his (or his CE or agent's) interaction with the game. The player then observes the game state as a result of the change of the variables and acts accordingly. As illustrated in the above diagram, f1 takes as an additional argument the RNG result from prior RNG events within the RWE.

In addition, the RWE 1040 provides the RNG results to database 1022. Database 1022 then stores the RNG results for future use by f1 1020. The f1 1020 ensures that subsequent dice rolls can be independent or dependent events with respect to prior dice rolls. Note also that "dice rolls" can be replaced by any random event within the coincident gambling hybrid game in the entertainment game context. For example, "a spin of a reel" could be the mechanism, or "the drawing of a card", "drawing straws" or "playing a round of Russian Roulette".

The ability of f1 1020 to reference prior RNG events also means that subsequent gambling events can be constructed as bonus rounds or special events (which may or may not include the commitment and/or payout of RC), for which players are made eligible as a result of prior RNG results. For example, in an adventure game, a player seeks to cast a spell. To successfully cast this spell, a very low probability event, the player must roll a twenty sided die (which in this example requires the commitment of 100 RC) and hit an '8'. The player does this (the AE), and the RNG returns an 8. A substantial RC payment is made, the spell is successfully cast within the entertainment game (as reflected in the entertainment game variables), and as a result the player is approached—in the entertainment game context—by a powerful wizard who offers the player the opportunity to acquire a new spell, requiring the rolling of a 10-sided die and hitting a one, two or three. This opportunity may or may not require the commitment of RC. Alternately, the bonus proposition may be a straight RC-related opportunity (which may or may not require the commitment of RC).

While the aforementioned examples have focused on an adventure game, the system is not limited to a specific game type or genre. For example, in a first person shooter, a trigger pull for a given weapon type can be associated with the rolling of a certain die for ascertaining whether the target is hit, and/or a die can be associated with establishing the amount of damage inflicted on the target if hit. For example, a pistol may hit its target on a roll of 1 or 2 on a 6-sided die, and may inflict between 1 and 6 damage points (again a 6-sided die), while a high powered rifle may hit on a 1, 2, 3, or 4 on a D10, and cause between 1 and 20 damage points (i.e. a 20-sided die). The rolling of the first die (the "did CE hit the target die") can be triggered by the pulling of a trigger (or pressing of a button, for example), and the second would be initiated as a function of the result of the first. In this example, a gambling game (and RC commitment) could be a function of the first, second, or both die rolls, i.e. the output of both RNG events may be data considered by the pay table when ascertaining the amount of RC to be paid to the player, this being coordinated by the actions of the f1, which selects the RNG and pay table as a function of current and historical data.

Figure 11:
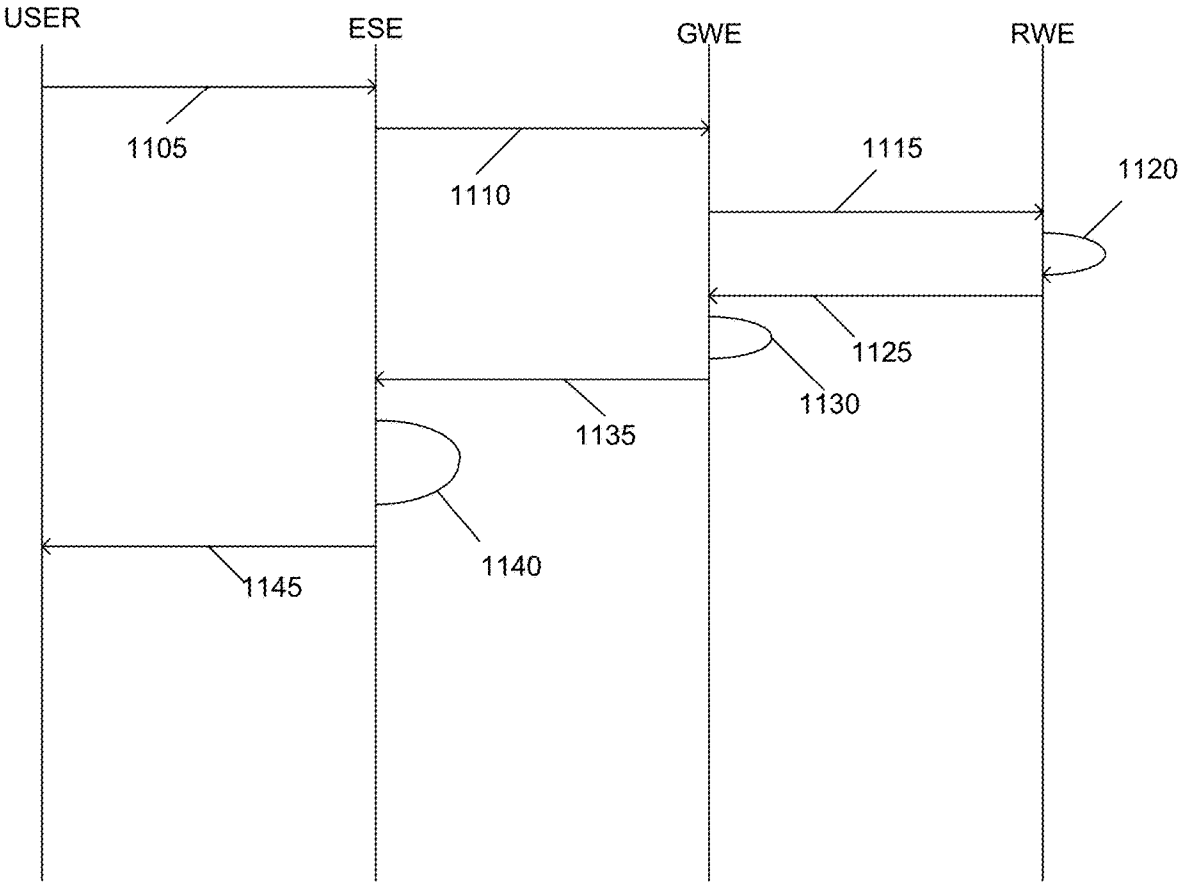
FIG. 11 illustrates a timing diagram of information passed between components of a system providing a coincident gambling hybrid game having coincident gambling and game events in accordance with embodiments of the invention.

Coincident Gambling Hybrid Game Providing Coincident Gambling Events and Game Events A system that provides a coincident gambling hybrid game including coincident gambling and game events in accordance with embodiments of the invention is shown in FIGS. 11-14. A timing diagram of the information passed between various components of the system to provide coincident gambling and game events is shown in FIG. 11. The process begins when the ESE receives an input (1105) of an action with respect to a CE in the entertainment game. Based upon the input action, the ESE determines an AE performed by the CE. The AE is then provided to the GWE (1110). With reference to the above description a function, f1, in the GWE then determines a gambling event that corresponds to the AE. A request (1115) for the gambling event is then provided by the GWE to the RWE. The RWE then determines the result of the gambling event (1120). The result of the gambling event is then provided by the RWE to GWE (1125). The GWE then uses a function, f2, to determine how the result of the gambling event affects the set of game variables (1130). Any required updates of the game variable in the set of game variables are then provided by the GWE to the ESE. The ESE updates the set of game variables according to the received updates (1140) and presents the updated game to the player (1145).

Figure 12:
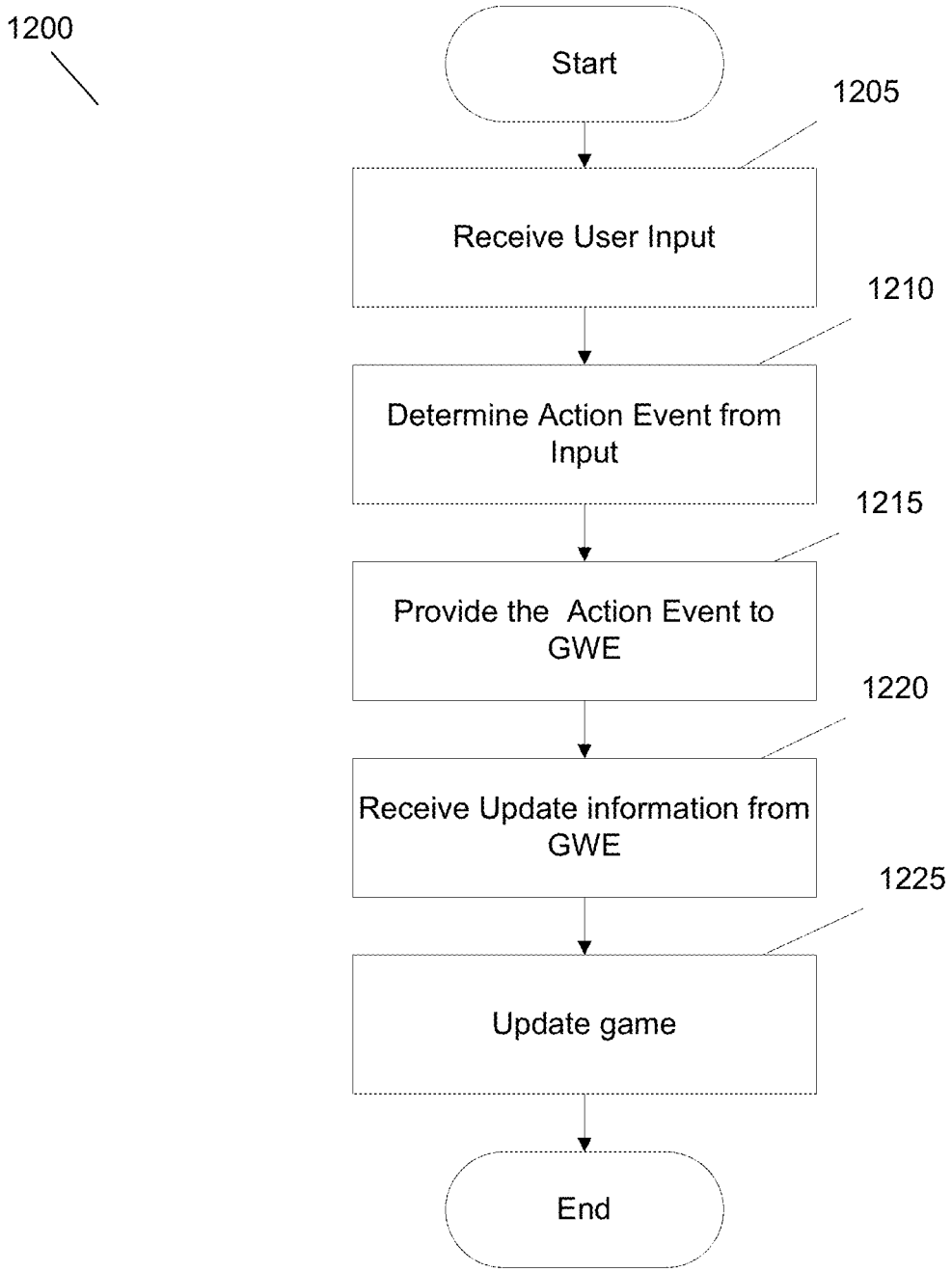
FIG. 12 illustrates a flow diagram of a process performed by an Entertainment System Engine to provide a coincident gambling hybrid game having coincident gambling and game events in accordance with embodiments of the invention.

A process for receiving the input from the player and updating the coincident gambling hybrid game based on the results of a gambling event in accordance with embodiments of the invention is shown in FIG. 12. In process 1200, the ESE receives the input from the player (1205). An AE that is performed by the CE based upon the input is determined (1210). The determined AE is then provided to the GWE by the ESE (1215). The update information for the game variables based upon the results of the gambling event is received from the GWE (1220) and the ESE updates the game accordingly (1225).

Figure 13:
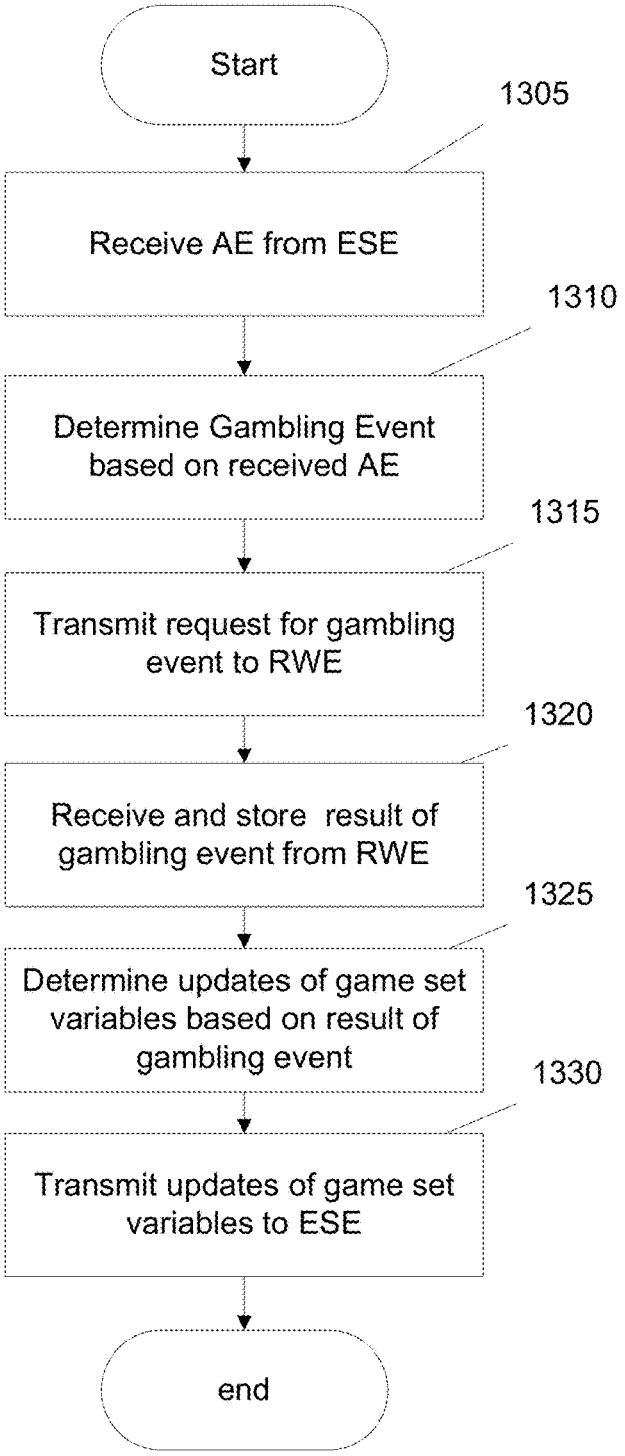
FIG. 13 illustrates a flow diagram of a process performed by a Game World Engine to provide a coincident gambling hybrid game having coincident gambling and game events in accordance with embodiments of the invention.

A process for determining a gambling event based upon an AE and how the results of the gambling event affect the variables of an entertainment game performed by a GWE in accordance with embodiments of the invention is shown in FIG. 13. In process 1300, the GWE receives an AE from the ESE (1305). The GWE then determines a gambling event that is to occur based on the AE (1310). The determination may be made by a function, f1, as described above with reference to FIGS. 8-10. Furthermore, as described above, the determination may also use a past gambling event and/or RNG results to make the determination of the gambling event. GWE also may determine an amount to wager on a gambling proposition of the gambling event. The GWE then requests the determined gambling event be performed by the RWE (1315). The request may include the amount of RWC wager on the proposition. The GWE then receives the results of the gambling event from the RWC (1320). The results provided to the GWE may also include RNG results and other information. The GWE may store the results and/or other information received in a database for use in determination of future gambling events. The results of the gambling events are used by the GWE to determine updates of the game variables (1325). The updates are transmitted by the GWE to the ESE (1330).

Figure 14:
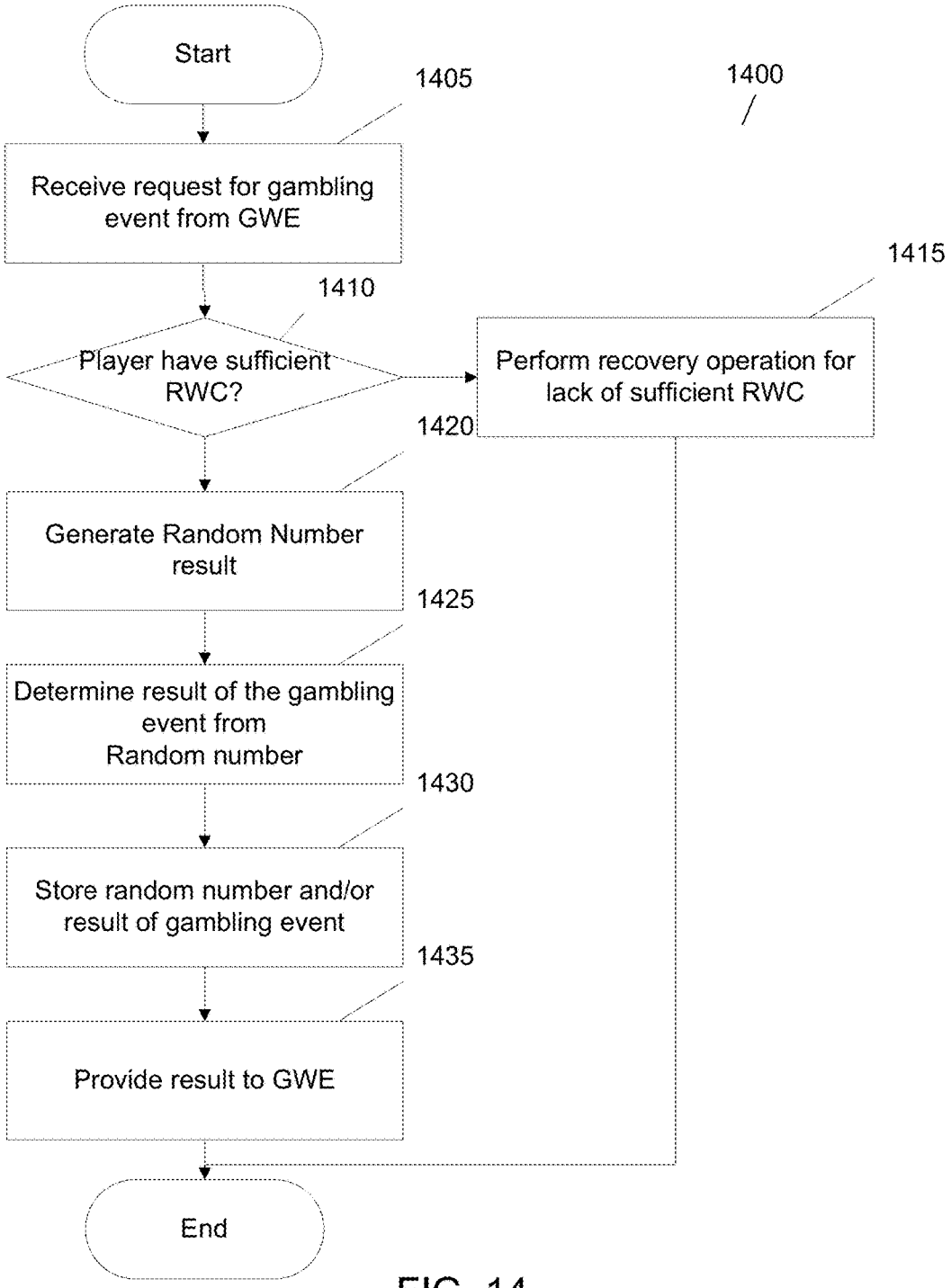
FIG. 14 illustrates a flow diagram of a process performed by Real World Engine to provide a coincident gambling hybrid game having coincident gambling and game events in accordance with embodiments of the invention.

A process performed by the RWE to determine the results of the gambling events and provide the results to the GWE in accordance with embodiments of the invention is shown in FIG. 14. In process 1400, the RWE receives a request for a gambling event from the GWE (1405). The request may include amount wagered, an indication of a proper RNG to use, and an indication of the pay tables to use to resolve the wager. The RWE determines whether the player has sufficient RWC available to cover the wager (1410). If the client does not have sufficient RWC to cover the wager, the RWE performs a recovery operation (1415). The recovery operation may prevent the wager from occurring or may allow the player to supply the necessary funds to cover the wager. If the player has sufficient RWC, the RWE generates a random number result using the proper RNG (1420). The random number result is then used to determine the results of the gambling event and do all other appropriate operations for updating the RWC available to the player (1425). The RWE may store the result and/or other information about the result, including the random number result, in a database for future use (1430). The RWE also provides the result of the gambling event to the GWE (1435).

Although certain specific features and aspects of a gaming system have been described herein, many additional modifications and variations would be apparent to those skilled in the art. For example, the features and aspects described herein may be implemented independently, cooperatively or alternatively without deviating from the spirit of the disclosure. It is therefore to be understood that gaming system may be practiced otherwise than as specifically described. Thus, the foregoing description of the gaming system should be considered in all respects as illustrative and not restrictive, the scope of the claims to be determined as supported by this disclosure and the claims' equivalents, rather than the foregoing description.

What is claimed is:

1. A distributed coincident gambling hybrid gaming system having coincident gambling events and game events provided on a computing device, comprising:

an entertainment engine connected by a network to a game world engine, wherein the entertainment engine is configured to:

execute an entertainment game on the computing device, including receiving a first input and determining a first action event in the entertainment game from the first input;

display a user interface for the entertainment game;

provide to the game world engine via the network, the first action event;

receive from the game world engine via the network, a change to a set of entertainment game state variables;

receive, from the game world engine via the network, a first random outcome;

display the first random outcome via the user interface for the entertainment game;

incorporate the change to the set of entertainment game state variables into the entertainment game by modifying the entertainment game;

execute the entertainment game on the computing device, including receiving a second input and determining a second action event in the entertainment game from the second input; and provide to the game world engine via the network, the second action event;

a real world engine connected to the game world engine, wherein the real world engine is constructed to:

receive a request from the game world engine to determine a first outcome of a first gambling event;

determine the first random outcome using a random number generator;

determine the first outcome of the first gambling event using the first random outcome and a paytable;

resolve a first wager of the first gambling event based on the first outcome of the first gambling event;

store the first random outcome from the random number generator in a database accessible by the game world engine;

manage real world credits of a player based on the first wager;

provide to the game world engine the first random outcome of the gambling event;

receive a request from the game world engine to determine a second outcome of a second gambling event;

determine a second random outcome using a random number generator; and determine the outcome of the second gambling event using the second random outcome, the first random outcome and the paytable; and the game world engine connected by the network to the entertainment engine and connected to the real world engine, wherein the game world engine is constructed to:

receive from the entertainment engine via the network, the first action event;

determine whether the first action event is associated with the first gambling event;

provide to the real world engine, the request to determine the first outcome of the first gambling event;

receive from the real world engine the first random outcome;

determine the change in the set of entertainment game state variables based on the first random outcome;

provide to the entertainment engine via the network, the change in the set of entertainment game state variables;

provide to the entertainment engine via the network, the first random outcome;

receive from the entertainment engine via the network, the second action event;

determine whether the second action event is associated with the second gambling event;

provide to the real world engine, the request to determine the second outcome of the second gambling event; and receive from the real world engine the second random outcome.

2. The distributed coincident gambling hybrid gaming system of claim 1 wherein the random number generator uses a pseudo number generation process to generate the first random outcome.

3. The distributed coincident gambling hybrid gaming system of claim 1 wherein the real world engine selects one random number generator from a plurality of random number generators to generate random number information based on the first gambling event.

4. The distributed coincident gambling hybrid gaming system of claim 1 wherein the real world engine determines a second pay table to use to resolve the second wager of the second gambling event based upon the first gambling event.

5. The distributed coincident gambling hybrid gaming system of claim 1 wherein the real world engine and the game world engine are constructed using a same processing apparatus.

6. The distributed coincident gambling hybrid gaming system of claim 1 wherein the real world engine and the game world engine are connected by the network.

* * * * *